United States Patent [19]

Billerbeck et al.

[11] 4,085,395

[45] Apr. 18, 1978

[54] HIGH VOLTAGE TRANSFORMER PACKAGE

[75] Inventors: Wilfred Jerome Billerbeck, Silver Spring; Nelson Mortimer Jacobus, Jr., Kensington, both of Md.

[73] Assignee: Communications Satellite Corporation, Washington, D.C.

[21] Appl. No.: 765,329

[22] Filed: Feb. 3, 1977

[51] Int. Cl.[2] ..... H01F 27/02; H01F 27/08

[52] U.S. Cl. ..... 336/61; 336/90; 336/92; 336/94

[58] Field of Search ..... 336/90, 92, 94, 55, 336/57, 58, 59, 60, 61; 174/12 R, 12 BH, 16 R, 15 R, 17 LF

[56] References Cited

U.S. PATENT DOCUMENTS

| | | | |
|---|---|---|---|
| 1,571,300 | 2/1926 | Reed | 124/16 R |
| 2,351,097 | 6/1944 | Boeringer | 336/92 |
| 3,043,900 | 7/1962 | Reisinger | 174/12 R |
| 3,082,391 | 3/1963 | Chiki | 336/92 X |
| 3,125,735 | 3/1964 | Twomey | 336/92 |
| 3,270,305 | 8/1966 | Glassanos | 336/90 X |
| 3,617,966 | 11/1971 | Trench et al. | 336/61 |
| 3,621,561 | 11/1971 | Higbee et al. | 336/90 |
| 3,644,658 | 2/1972 | Kuti et al. | 174/17 LF |
| 3,883,206 | 5/1975 | Baughman | 336/92 X |
| 4,009,459 | 2/1977 | Benson et al. | 336/61 X |

FOREIGN PATENT DOCUMENTS

| | | | |
|---|---|---|---|
| 1,020,141 | 2/1953 | France | 336/61 |
| 1,525,563 | 5/1968 | France | 336/61 |
| 171,954 | 2/1904 | Germany | 336/58 |

*Primary Examiner*—Thomas J. Kozma
*Attorney, Agent, or Firm*—Sughrue, Rothwell, Mion, Zinn and Macpeak

[57] ABSTRACT

A thin wall, stainless steel transformer case of rectangular box configuration is comprised of edge welded steel plates with its sidewalls and end walls bearing vertical, U-shaped bonded channel members of copper for mechanical reinforcement of the case and for forming transformer heat dissipating fins. Stainless steel reinforcing channel members are similarly bonded to the outside of the case bottom wall and the cover. An epoxy fiberglass strap spanning interiorly between the sidewalls of the case at its upper end and bolted to opposed brackets press the transformer core against the bottom wall of the transformer case. A pair of deformable tubes sealably project through the cover for effecting vacuum evacuation of the interior with the cover sealed to the case and for feeding insulating dielectric liquid to the transformer case interior. The tubes are pinched off and sealed after filling.

9 Claims, 4 Drawing Figures

HIGH VOLTAGE TRANSFORMER PACKAGE

BACKGROUND OF THE INVENTION

High voltage transformer packages of the prior art are characterized by metal cases formed of a high thermal conductive metal such as aluminum or copper to effect rapid and efficient heat dissipation of the heat evolved during transformer operation under electrical load. Where the cases have been formed of copper or the like, the walls have been joined together and to the cover, for instance, by soldering at their abutting edges. However, soldered copper cases have normally suffered from leaks due to pressures generated internally during use, and the use of copper, aluminum and other soft but highly conductive metals inherently results in a case which lacks sufficient structural strength to permit the vacuum filling of the cases with dielectric liquid within which the transformer coils are immersed. Where the transformer package involves a cast housing or case, the cast housing while being adequately leak proof and of adequate structural strength to permit vacuum filling, is quite heavy in construction and with respect to the soldered copper or aluminum cases they are not designed to be readily reproducible; they lack operational reliability and are not vented for safety.

SUMMARY OF THE INVENTION

The present invention is directed to an improved high voltage transformer package which is characterized by a thin-wall stainless steel case of two part construction in the form of a rectangular, open top box formed of stainless sheet steel which is closed off by a stainless steel cover which is welded to the box at the cover edges to complete a pressure resistant, sealed stainless steel case. Prior to welding of the cover to the box, one or more high voltage transformers is placed within the case. The transformer may comprise a rectangular, O-shaped core which rests on the bottom wall of the transformer case. An epoxy fiberglass bar with a recess within its lower surface spans across the core and is bolted at respective ends to a pair of opposed brackets at the top center of the box sidewalls to press the core against the bottom wall of the transformer case. Throughout electrical terminals project through the case sidewalls, mounted within insulating bushings to form sealed electrical connections to the primary and secondary windings of the transformer. A pair of deformable tubes project through the cover and are sealed thereto for effecting evacuation of the case interior subsequent to the cover being sealed in place and the addition of dielectric liquid to the extent of covering of the transformer windings but leaving a dead space at the top of the case to permit for liquid expansion. A pressure relief valve is fixed to the cover to permit dielectric liquid discharge upon excessive pressure due to thermal stress. U-shaped channel members of copper or aluminum are bonded to the exterior of the stainless steel case sidewalls and end walls to dissipate generated heat by convection air current or forced air flow parallel to the channels and to mechanically reinforce the stainless steel case walls. Stainless steel U-shaped channels may be bonded to the exterior of the bottom wall of the transformer case and to the exterior of the cover to mechanically reinforce these stainless steel case walls.

DESCRIPTION OF THE PREFERRED EMBODIMENT

Figure 3:
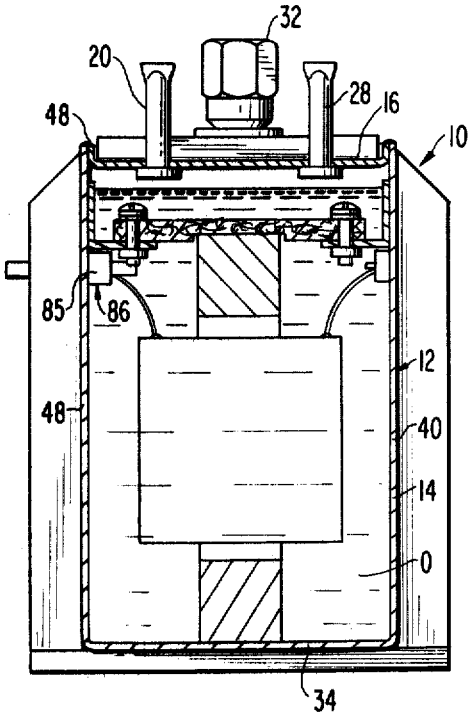
FIG. 3 is a transverse vertical sectional view of the transformer package of FIGS. 1 and 2 upon completion of assembly.

Referring to the drawings, the improved high voltage transformer package of the present invention is indicated generally at 10 and having as its principal components a transformer case 12 formed by an open top box 14, and cover 16, a transformer indicated generally at 18, and comprising an O-shaped core 20, a primary coil or winding 22 and a secondary coil or winding 24, a mounting strap 26, a pair of deformable tubes 28 and 30 mounted to cover 14, and a pressure relief valve 32, FIG. 3, which is centered on the same cover.

Figure 1:
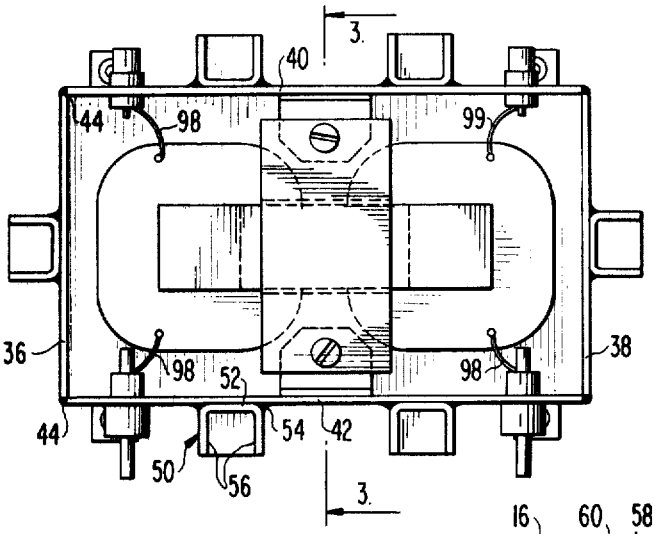
FIG. 1 is a top plan view of one embodiment of the improved high voltage transformer package of the present invention, with the cover removed.

In contrast to the previous designs, the present invention employs thin-wall stainless sheet steel to form both the box 14 and the cover 16 of case 12. The stainless steel box 14 in thin-wall sheet form comprises a bottom wall 34, longitudinally spaced end walls 36 and 38 to the left and right, FIG. 1, and laterally opposed sidewalls 40 and 42. In this regard, the stainless steel sheet metal bottom wall 34 and sidewalls 40 and 42 may be integral, with the sidewalls 40 and 42 simply being bent at right angles to bottom wall 34. Assuming that to be the case, the end walls 36 and 38 may be rectangular plates having a vertical height equal to that of the sidewalls 40 and 42 and having a width equal to the width of the bottom wall 34 and being welded to these members along the edges as indicated at 44. During the construction and assembly of the transformer package, the cover 14 which constitutes a unitary member formed of stainless steel sheet material, preferably identical to that forming the box 14, is shown as being provided with flanged lateral edges 46 and longitudinal edges 47, which permit the cover to be partially inserted within the open top of the box and welded thereto around the abutting side and end walls as at 48, FIG. 3. Due to the thermal stress which occurs in high voltage transformer packages as a result of the heat generated during energization of the transformer 18, the present invention advantageously employs a plurality of U-shaped copper channel members indicated generally at 50 which extend vertically to and are mounted to the exterior of the box sidewalls and end walls, the channel members 50 including a base portion 52 which is bonded to the external surface of the side and end walls by means of an epoxy or similar like bonding material 54, the channel members thereby each including a pair of parallel fins 56 which project at right angles to the transformer case wall and channel member base portion 52. The channel members 50 are oriented vertically with respect to the illustrated embodiment, this permitting efficient heat transfer by convection air currents which air rises and passes over the exterior surfaces of box 14. The copper channel members 50 perform in addition to a heat dissipation or heat transfer function, the function of mechanically reinforcing the thin stainless steel walls of box 14 at areas intermediate of the ends of the sidewalls and end walls of that member. The center base or portion 52 of the channel members 50 are sized so as to maintain satisfactory stress levels in the adhesive bond 54 which bonds the channel members to the walls of box 14, the adhesive bond being an epoxy resin in this particular illustrated embodiment. It is also an important design constraint that the bond area between the channel members 50 and the walls of the box 14 be made large enough so that under operating conditions the temperature differential across the stainless steel case and the bond material is satisfactorily low, that is, a few degrees Celsius. The thickness of the copper fins 56 and their lateral width at right angles to the vertical walls of box 14 are such as to conduct the heat from the interior of the transformer package and exchange it to the air passing over the fins under the worst possible conditions for forced and free convection. Further, since the copper channel members 50 perform a reinforcing structure function with respect to the stainless steel walls upon which they are mounted, the dimensions of the copper channel members 50 are also sized to resist structural buckling of walls 36, 38, 40 and 42 under the pressures created internally as result of transformer operation under applied electrical load.

In addition to the copper channel members 50, which are mounted to the end walls and sidewalls of box 14, the present invention employs stainless steel channel members 58 which are welded to cover 16 on its upper, outer surface, the channel members 58 extending transversely across the cover between the flanged edges 46 with fins 60 of the channel members 58 projecting outwardly therefrom at right angles thereto. Further, similar stainless steel sheet metal channel members 62 are fixed to the bottom surface of bottom wall 34 as by being welded thereto, these members extending transversely from one side of the package to the other and forming fins 64 which project at right angles to the bottom wall 34 of box 14. While the stainless steel channel members 58 and 62 inherently perform a heat dissipating function, they primarily act in a structural support or reinforcing function. That is, they reinforce and strengthen cover 16 and bottom wall 34 respectively of case 12 to prevent buckling.

Since the high voltage transformer is subjected to substantial mechanical shock and vibration stresses during shipping and other handling, it is necessary to securely mechanically mount and maintain the transformer or transformers within case 12. In the illustrated embodiment, the O-shaped core 20 of the single transformer 18 may comprise a cast ferrite or a series of laminated magnetic metal sheets with primary winding 22 and secondary winding 24 being concentrically mounted to respective legs of core 20 in side-by-side fashion with the axis of the individual windings or coils 22 and 24 being vertical and with the core and windings forming an assembly whose longitudinal dimension is somewhat less than the longitudinal dimensions of the box 14 interior within which the transformer 18 resides.

Figure 2:
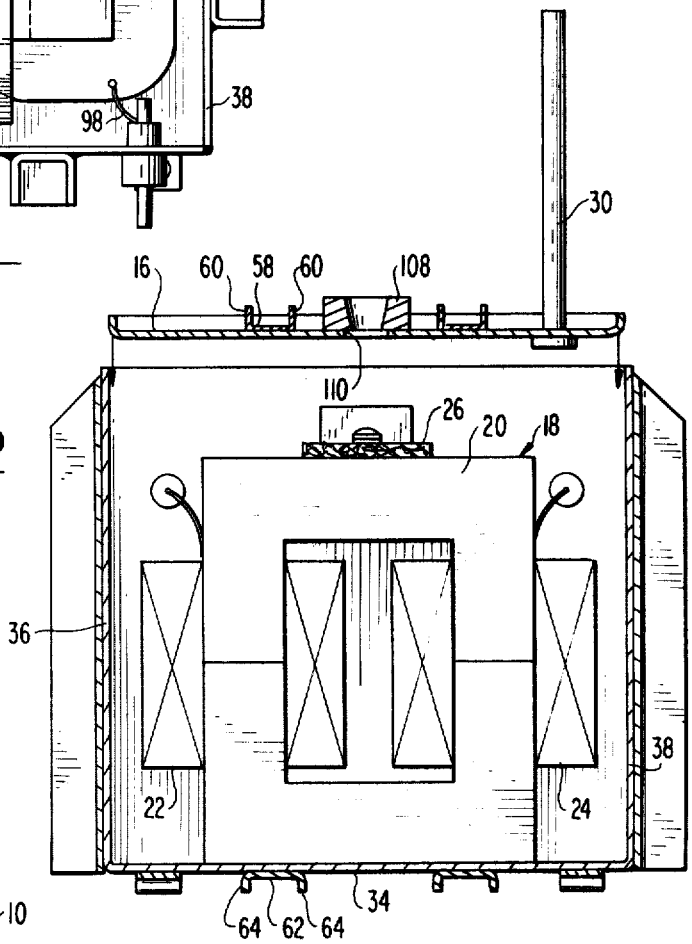
FIG. 2 is a vertical sectional view of the transformer package of FIG. 1 about lines II—II and with the cover being positioned on the transformer case prior to welding thereto.

With the cover 16 removed, the assembly of core 20 and coils 22 and 24 are inserted within the interior of box 14 such that core 20 simply rests on the bottom wall 34 of box 14, FIG. 2. A pair of L-shaped steel brackets 66 are mounted to respective sidewalls 40 and 42, on the inside of box 14, and at the top center of the box 14 to face each other. The brackets 66 have their vertical walls 68 welded to the interior of sidewalls 40 and 42 and have horizontal portions 70 at right angles to walls 68 projecting towards each other, the portions 70 each being provided with a hole as at 72. The brackets 66 are located such that the horizontal portions 70 are just below the top of the core 20. An epoxy fiberglass mounting strap or bar 74 of a length less than the distance between the sidewalls 40 and 42 is mounted to the brackets 66. Strap 74 is provided with laterally spaced holes 75 of a diameter equal to that of holes 72 within the brackets through which extend mounting bolts 76. The bolts 76 carry split lock washers 78 at their headed ends and the assembly is completed by nuts 80 which are threaded to the lower ends of the mounting bolts 76. The mounting strap 74 bears a rectangular recess or cut out 82 on its bottom, of a length slightly greater than the width of core 20, the core being received within the recess 82 and being pressed against the bottom wall 34 by tightening down of nuts 80 on the mounting bolts 76.

Sidewall 40 of the box 14 is apertured at 84 on both sides of bracket 66 and sealably supports by way of bushings 85, flange receptacles or terminals indicated generally at 86. Each bears a metal conductor 88 which is electrically insulated from the sheet steel sidewall 40 by way of bushing 85. The opposite sidewall 42 is also apertured as at 90 through which projects bushing 92 of the metalized ceramic terminal indicated generally at 94. Bushing 92 sealably mounts terminal 94. Terminals 86 and 94 permit external electrical connection, by way of leads or wires 98 to appropriate sides of primary and secondary coils 22 and 24. The exterior ends of terminals 94 may, for instance, be appropriately threaded (not shown) and thus may receive a threaded nut (not shown) for making external electrical cable connections. It is important that the bushings 85 and 92 of terminals 86 and 94 perform both an electrical insulating function and a liquid sealing function with respect to the dielectric liquid such as oil O which fills most of the interior of the box 14 after completion of the assembly, FIG. 3.

Figure 4:
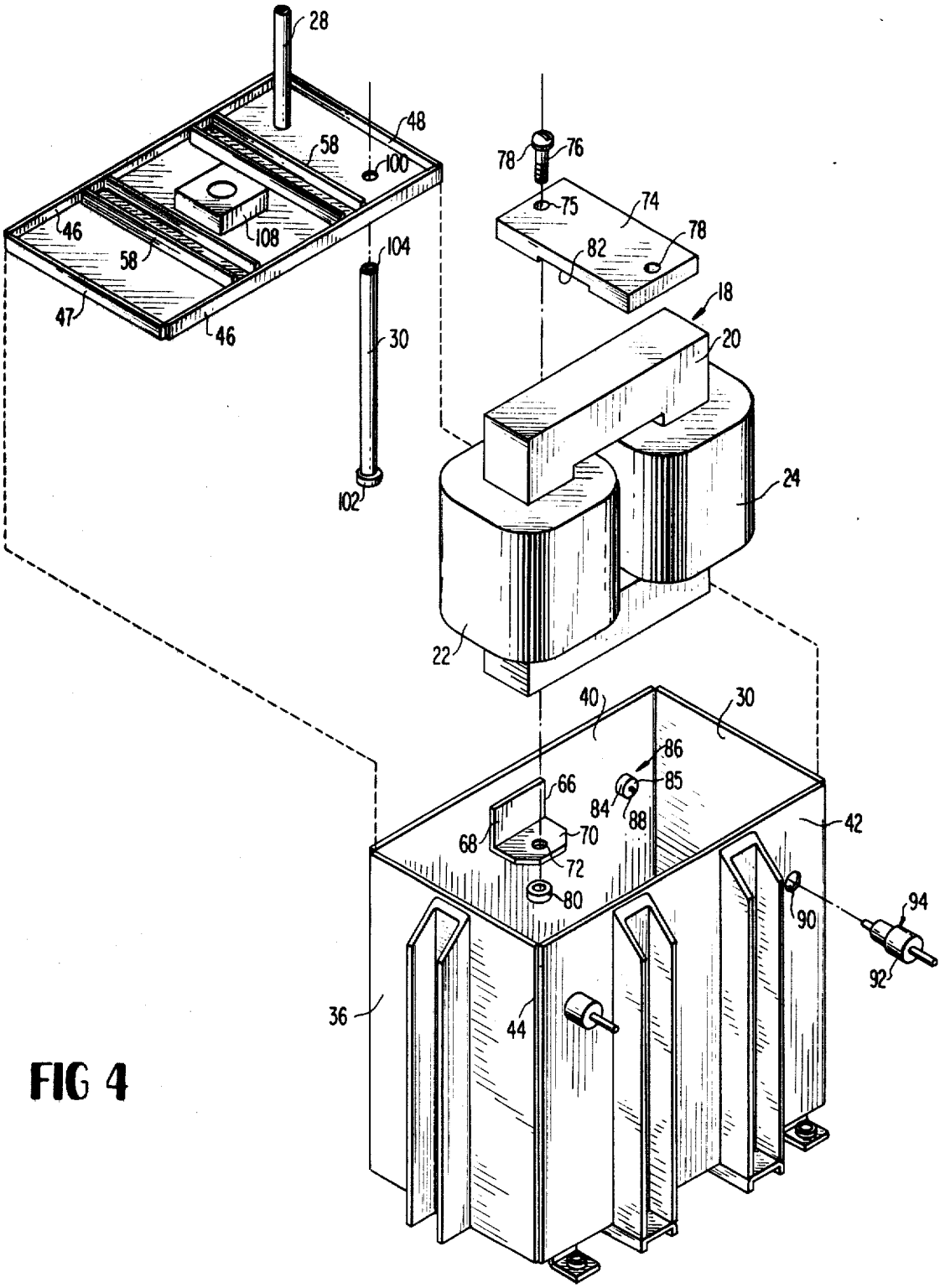
FIG. 4 is an exploded, perspective view of the transformer package of FIGS. 1-3 showing the method of assembly of the components thereof.

In that respect, the cover 16 is provided, as mentioned previously, with two tubes 28 and 30 which project through the cover and permit the evacuation of the case interior and the filling of the same with dielectric liquid O subsequent to completion of assembly of the transformer package and the welding of cover 16 to box 14. As best seen in FIG. 4, the cover is provided with two holes 100 which are in transverse alignment adjacent one end of the cover and through which project respective tubes 28 and 30. The tubes 28 and 30 may be formed of a deformable metal such as copper and formed with flange ends as at 102 and after being inserted through the holes 100 from the bottom upwardly, FIG. 4, the tubes 28 and 30 are appropriately soldered in the area of their passthrough to cover 16. The tubes 28 and 30 are open at their upper ends as at 104 prior to evacuation and filling of case 12 with dielectric liquid.

In FIG. 2, with the tubes 28 and 30 open at their upper ends and sealably mounted to the cover 16, the cover 16 is partially inserted within the upper end of box 14, whereupon the cover 16 is welded at its edge flanges 46 and 47 to the upper end of end walls 36, 38 and sidewalls 40, 42 as at 48, completing a thin-wall, sealed stainless steel case 12 for the transformer package. The low thermal conductivity and good weldability of stainless steel acts as a special advantage in allowing the cover to be welded to the box without damage to the electrical components, that is, the terminals, bushings, and in particular the transformer coils or windings 22 and 24.

At this point, or prior to mounting of the cover 14 to the box 14, a conventional pressure relief valve as at 32 may be threadably mounted to an apertured mounting block 108 which is fixed to the center of cover 16 between reinforcing channel members 58, the block 108 being mounted coaxially of hole or opening 110 within the cover, leading to the interior of the case 12. The pressure relief valve 32 is of the commercially available type; it may be of the type manufactured by Circle Seal under part number 5-32-B-2MP-50 and functions to permit the air or dielectric liquid to discharge from the interior of the case 12 upon excessive pressure rise due to heat increase when the transformer 18 is subjected to excessive load, or there is insufficient cooling of the transformer package by air flow over channel members 50, 58 and 62. The transformer 18 is mounted within box 14 and the electrical connections made by way of leads or wires 96 and 98 to the primary and secondary coils 22 and 24 and the completion of the electrical feedthroughs prior to the cover being attached by welding as at 48.

In terms of one specific method which may be employed in the assembly and completion of the high voltage transformer package of the present invention, after the assembly steps described below, and the welding of the cover 16 to the box 14, and following the filling with oil, the tubes 28 and 30 are soldered by commercially available solder such as All State 430 or equivalent to the cover after projecting the open upper ends through holes 100 from the cover bottom to the extent of flanged lower ends 102. Appropriate tests may be made to check for leaks for tubes 28 and 30 relative to their supporting cover 16. Lab tests and voltage tests may be applied with respect to the high and low voltage feedthroughs 86, 94. After the assembling of the transformer 18 into the box 14 and the bolting down of the fiberglass retaining strap 74 by way of bolts 76 and after appropriate tests on the transformer winding such as short and ground tests and upon completion of connections between the feedthrough terminals 86 and 92 by way of leads 98 and 96 respectively, the cover is ready to assemble to box 14. Preferably, the box 14 is thermally coupled to a heat sink to avoid exposure of the feedthroughs to high temperature during welding of the cover to the box. The temperatures of the connections and feedthroughs should be limited to less than 350° F when welding the cover to the box. Gas leakage tests of the sealed case such as helium leakage tests may be employed upon completion of weld 48.

Preferably, the transformer 18 is baked out for a number of hours at a temperature on the order of 60° C and during this operation vacuum pressure may be applied to both tubes 28 and 30 to insure removal of gaseous contaminants and the like. The transformer package is then ready for filling with the dielectric liquid O which may comprise a commercially available temperature transformer oil O such as Dow Corning DC-200 silicon oil, dielectric grade, 50 cs viscosity. During this step of the manufacturing process, the oil should be degassed under vacuum while warming to 60° C. Thereupon, the oil reservoir is connected by way of a stop cock (not shown) to tube 28 which supplies oil to the interior of case 12. At the same time, vacuum pressure is applied by way of tube 30 to the interior of the case and the oil flow controlled through the stop cock, this allowing the oil to flow slowly enough into the interior of box 14 to avoid bubbles. Preferably, the transformer case is completely filled with oil, and the stop clock is closed and bled back to atmospheric pressure. The transformer temperature is stabilized for one hour, keeping the transformer assembly filled with dielectric liquid. A small volume of the dielectric liquid or oil O is then removed by the application of vacuum pressure to tube 30 after tube 28 is closed off to the oil source by way of the stop cock. This extracts a measured quantity of oil from the unit to provide a gas cushion at the top of the unit and above the level of the core and winding which allows for the differential thermal expansion of the oil and the case under various design, storage and operating conditions while maintaining the maximum pressure within the structural capabilities. In the illustrated embodiment of the invention, the structural design pressure is approximately 0 psig during vacuum fill and up to about 50 psig at maximum operating temperature. The pressure relief valve 32 may be set at the vessel proof pressure such as 75 psig to provide safety in case of transformer malfunction. That is, it permits the discharge of the air or dielectric liquid under excessive pressure to prevent rupture of the case. Final electrical testing may then be made for possible grounds, shorts and for design high voltage.

From the above, it may be seen that the present invention produces a high voltage transformer package characterized by a hosuing or casing which provides a seal proof container for a liquid dielectric insulation and with special provisions for good transfer of heat generated within the casing to air circulation across its exterior in terms of a simple, safe package that is inexpensive to manufacture and to test and provides for high reliability under extended use. While the invention has been described in terms of a stainless steel casing employing epoxy resin bonding of the heat transfer channel members to the stainless steel wall, alternative bonding techniques may be employed for bonding of the fins to the case. For instance, oven-brazed bonding of the copper channels to the stainless steel casing may be employed.

Further, while the fins are illustrated as being formed by U-shaped channel members, the configuration of these heat transmitting members may alternatively be of L- or Z-shape as desired. The material making up the fins, in addition to being copper may be of aluminum, brass or other good thermal conductor material. They may be oriented horizontally with respect to the side and end walls of the case rather than vertically, particularly if it is desired to utilize mainly forced rather than mainly natural convection for fin cooling. While the dielectric media preferably comprises silicon liquid, alternatively, organic transformer oils, silicate ester oils and inert gases like $SF_6$ may be employed in lieu thereof. Further, while the vertical channel members 50 are shown as being longitudinally aligned with the sheet steel channel members 62 and in contact with respective ends of these members, FIG. 4, and while the vertical upper ends of the channel members 50 are oblique, various changes in their positioning and configuration may be employed to facilitate heat transmission and to improve esthetic aspects of the present design.

While the invention has been particularly shown and described with reference to a preferred embodiment thereof, it will be understood by those skilled in the art that various changes in form and details may be made therein without departing from the spirit and scope of the invention.

What is claimed is:

1. In a high voltage transformer package comprising:
a metal case,
a transformer coil and core assembly fixedly positioned within said case,
a dielectric liquid media within said sealed case with said transformer assembly immersed therein, and
terminals electrically connected to said transformer coils and electrically insulatively and sealably projecting through the walls of said case,
the improvement wherein:
said case comprises thin-wall sheet steel in the form of a closed box having longitudinally opposed end walls, laterally opposed sidewalls, and a bottom wall, said walls having their confronting edges welded together, and a cover welded about its edges to the top edges of said case sidewalls and said end walls,
a plurality of reinforcing members comprising integral angled base and fin portions mechanically fixed by their base portions at positions internally of the case corners to at least some of the exterior walls of said box to resist internal dielectric liquid pressure loading of the thin-wall sheet steel case wall during transformer operation under varying ambient conditions;
and wherein at least some of said reinforcing members are formed of sheet metal which is softer and of higher thermal conductivity than the thin-wall sheet steel forming said case box and cover to facilitate heat dissipation of said transformer package.

2. The high voltage transformer package as claimed in claim 1, wherein said reinforcing members comprise U-shaped channel members having base portions fixed to the sheet metal walls of said case and having integral fins extending at right angles thereto, away from said case walls.

3. The high voltage transformer package as claimed in claim 2, wherein said U-shaped channel members comprise stainless steel members mounted to the bottom wall and the cover of said sheet steel case at spaced positions thereon and copper channel members mounted at spaced positions to the sidewalls and end walls of said case with the channels formed thereby extending vertically.

4. The high voltage transformer package as claimed in claim 1, wherein said transformer assembly comprises an O-shaped rectangular core in upstanding position within the center of said steel case box and having primary and secondary coils encircling opposed vertical legs of said core, L-shaped bracket members mounted in laterally opposed top center positions at respective sidewalls of said casing and having horizontal portions extending laterally towards each other and towards the transformer core and an electrically insulating epoxy fiberglass strap fixedly mounted at respective ends to the horizontal portions of said bracket members and spanning the interior of the steel case box, overlying the top of said core and pressing the bottom of said core against the thin-wall sheet steel bottom wall of said case.

5. The high voltage transformer package as claimed in claim 3, wherein said transformer assembly comprises an O-shaped rectangular core in upstranding position within the center of said steel case box and having primary and secondary coils encircling opposed vertical legs of said core, L-shaped bracket members mounted in laterally opposed top center positions at respective sidewalls of said casing and having horizontal portions extending laterally towards each other and towards the transformer core and an electrically insulating epoxy fiberglass strap fixedly mounted at respective ends to the horizontal portions of said bracket members and spanning the interior of the steel case box, overlying the top of said core and pressing the bottom of said core against the thin-wall sheet steel bottom wall of said case.

6. The high voltage transformer package as claimed in claim 1, wherein said cover further comprises a pair of tubes fixedly mounted thereto and projecting through said cover for respectively permitting simultaneous evacuation of the air from inside said sealed sheet steel case and supplying of said dielectric media thereto and wherein the projecting ends of said tubes are pinched off to seal the steel case interior subsequent to evacuation and at least partially filling of the steel case interior with said dielectric media, and a pressure relief valve carried by said case for relieving excessive internal fluid pressure during transformer operation.

7. The high voltage transformer package as claimed in claim 3, wherein said cover further comprises a pair of tubes fixedly mounted thereto and projecting through said cover for respectively permitting simultaneous evacuation of the air from inside said sealed sheet steel case and supplying of said dielectric media thereto and wherein the projecting ends of said tubes are pinched off to seal the steel case interior subsequent to evacuation and at least partially filling of the steel case interior with said dielectric media, and a pressure relief valve carried by said case for relieving excessive internal fluid pressure during transformer operation.

8. The high voltage transformer package as claimed in claim 4, wherein said cover further comprises a pair of tubes fixedly mounted thereto and projecting through said cover for respectively permitting simultaneous evacuation of the air from inside said sealed sheet steel case and supplying of said dielectric media thereto and wherein the projecting ends of said tubes are pinched off to seal the steel case interior subsequent to evacuation and at least partially filling of the steel case interior with said dielectric media, and a pressure relief valve carried by said case for relieving excessive internal fluid pressure during transformer operation.

9. The high voltage transformer package as claimed in claim 5, wherein said cover further comprises a pair of tubes fixedly mounted thereto and projecting through said cover for respectively permitting simultaneous evacuation of the air from inside said sealed sheet steel case and supplying of said dielectric media thereto and wherein the projecting ends of said tubes are pinched off to seal the steel case interior subsequent to evacuation and at least partially filling of the steel case interior with said dielectric media, and a pressure relief valve carried by said case for relieving excessive internal fluid pressure during transformer operation.

* * * * *